United States Patent [19]

Budzich

[11] Patent Number: 4,487,018

[45] Date of Patent: Dec. 11, 1984

[54] COMPENSATED FLUID FLOW CONTROL

[75] Inventor: Tadeusz Budzich, Moreland Hills, Ohio

[73] Assignee: Caterpillar Tractor Co., Peoria, Ill.

[21] Appl. No.: 357,034

[22] Filed: Mar. 11, 1982

[51] Int. Cl.[3] ..... F15B 13/02

[52] U.S. Cl. ..... 60/452; 91/451; 137/596.13

[58] Field of Search ..... 60/452, 443; 91/451; 137/596.13

[56] References Cited

U.S. PATENT DOCUMENTS 4,282,898 8/1981 Harmon et al. ..... 91/451

*Primary Examiner*—Robert E. Garrett
*Assistant Examiner*—John M. Husar
*Attorney, Agent, or Firm*—J. W. Burrows

[57] ABSTRACT

A compensated fluid flow control of a positive load, which automatically maintains a relatively constant pressure differential across a control orifice of a direction and flow control valve and which permits the variation in the level of this pressure differential in response to an external control signal, while this pressure differential is maintained constant at each specific level.

14 Claims, 5 Drawing Figures

COMPENSATED FLUID FLOW CONTROL

BACKGROUND OF THE INVENTION

This invention relates generally to a fluid flow control, in which the pressure differential across a variable orifice, positioned between the source of pressure and the load, is maintained constant irrespective of the variation in the system load.

In more particular aspects this invention relates to load compensated valve and pump controls, which control the magnitude of the fluid flow to a fluid motor, subjected to a positive load, by maintaining a constant pressure differential across a control orifice.

In still more particular aspects this invention relates to load compensated valve and pump controls, which permit variation in the level of the controlled pressure differential across an orifice, this pressure differential being maintained constant at each selected level.

Load compensated fluid flow controls are very desirable for a number of reasons. They permit positive load control with reduced power loss and therefore, increase system efficiency. When controlling a positive load they provide the proportional feature of flow control, irrespective of the variation in the magnitude of the load.

Such a fluid flow control, which maintains a constant pressure differential across a variable orifice by throttling the fluid flow delivered to the actuator is shown in my U.S. Pat. No. 3,470,694. A fluid flow control, which maintains a constant pressure differential across a variable orifice, by bypassing part of the fluid flow delivered to the actuator, is shown in U.S. Pat. No. 3,488,953 issued to Haussler. Also such a fluid flow control, which maintains a constant pressure differential across a variable orifice by variation in flow delivery of the system pump is shown in U.S. Pat. No. 3,693,506 issued to McMillan et al.

In all of those patents the variation in flow delivered to a fluid motor is accomplished by a single control input and that is by variation in the area of the control orifice, each specific area corresponding to a specific constant flow level. There are instances where a dual control input in controlling the flow to a fluid motor becomes very desirable.

A system showing a dual control input in control of the flow, namely variation in the area of the control orifice and variation in the level of pressure differential maintained constant across such an orifice is shown in U.S. Pat. No. 4,282,898 issued to Harmon et al. However while the control of Harmon changes the pressure differential acting across a control orifice in response to a control signal, this is accomplished in one step, to a specific higher level, requiring a nonproportional control pressure signal of a magnitude higher than that, equivalent to maximum system load pressure. In Harmon the pressure differential is not proportional to the control pressure signal and cannot be varied in a proportional way with it. Also since Harmon is increasing the pressure differential by compressing a spring, the total range of the pressure signals, equivalent to the preload of the spring, becomes ineffective.

SUMMARY OF THE INVENTION

It is therefore a principal object of this invention to provide a fluid flow control, which permits variation in the level of the control differential across a control orifice, while this control differential is automatically maintained constant at each controlled level.

Another object of this invention is to provide a load compensated valve or pump control, which permits variation in the level of control differential across a control orifice, interposed between the source of pressure and the fluid motor, proportionally to an external control signal, while this control differential is automatically maintained constant at each controlled level.

It is a further object of this invention to vary the pressure differential across a control orifice, proportionally in response to an external control signal, which can vary from zero to a maximum value, while this control differential is automatically maintained constant at each controlled level.

It is a further object of this invention to vary the pressure differential across a control orifice proportionally in response to an external pressure signal, this control differential being automatically maintained constant at each controlled level.

It is a further object of this invention to vary the pressure differential across a control orifice proportionally in response to an external electrical signal, this control differential being automatically maintained constant at each controlled level.

Briefly the foregoing and other additional objects and advantages of this invention are accomplished by providing a novel load compensated valve or pump control, in which the controlling element, subjected to the pressure differential across a control orifice, automatically maintains it constant. Application of additional control force, proportional to the magnitude of an external control signal, by disturbing the equilibrium of forces, to which the controlling element is subjected, proportionally varies the level cf the pressure differential developed across the control orifice, this pressure differential being automatically maintained constant at each controlled level.

Additional objects of this invention will become apparent when referring to the preferred embodiment of the invention as shown in the accompanying drawings and described in the following detailed description.

DESCRIPTION OF THE PREFERRED EMBODIMENTS

Figure 1:
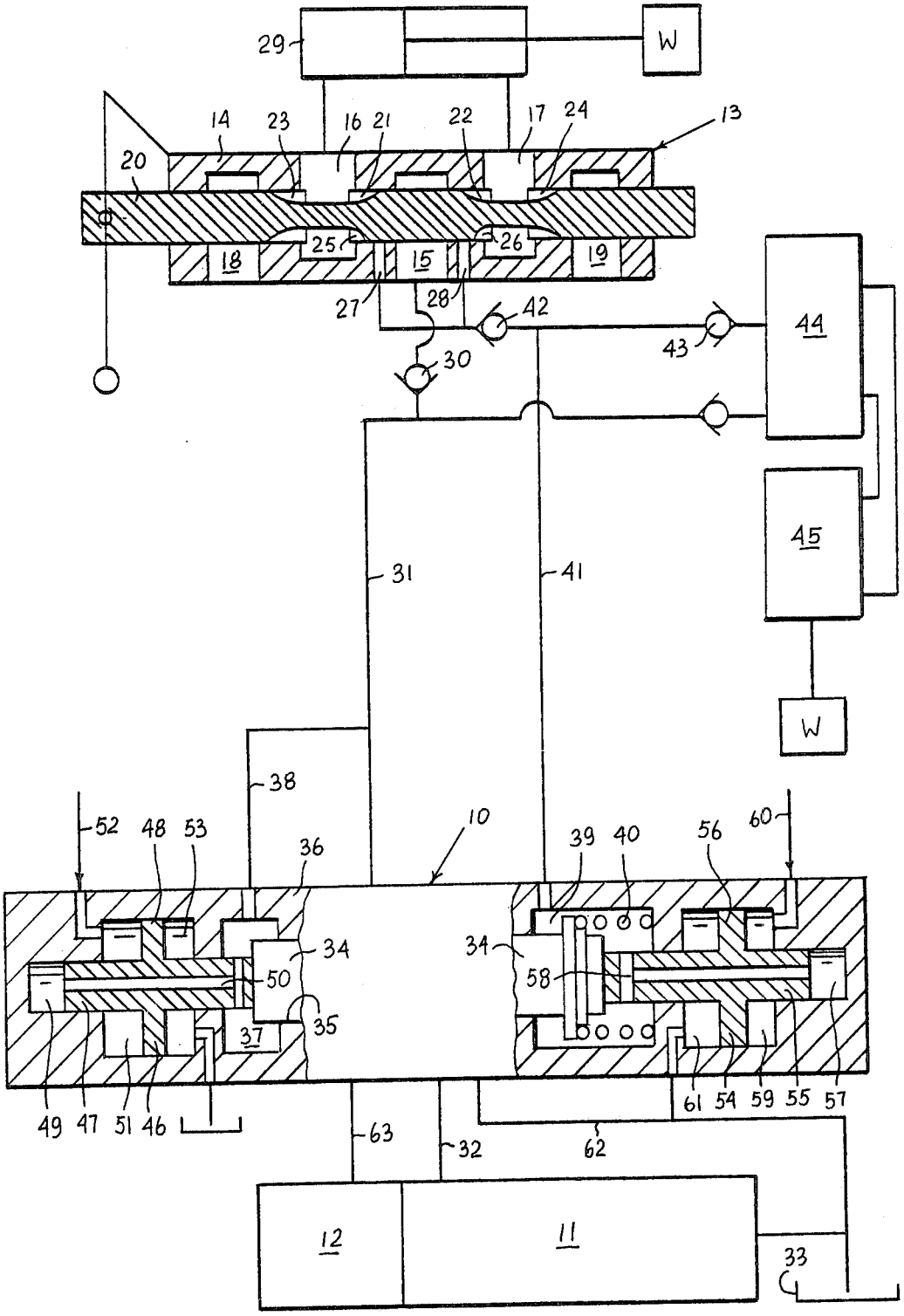
FIG. 1 is a schematic representation of a load compensated variable pressure differential valve or pump flow control, with load sensing direction and flow control valve shown diagrammatically.
Figure 1A:
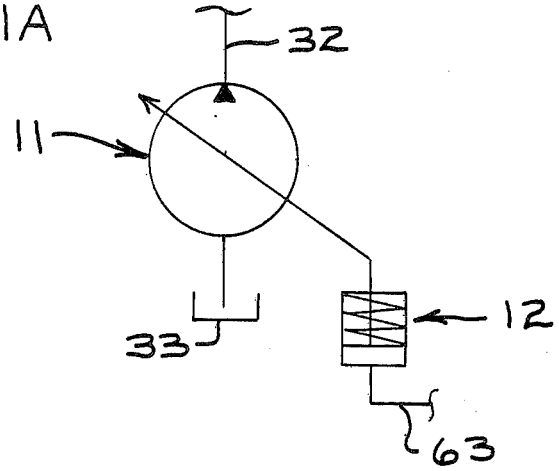
FIG. 1A is a schematic representation of a flow changing mechanism for a variable displacement pump.
Figure 1B:
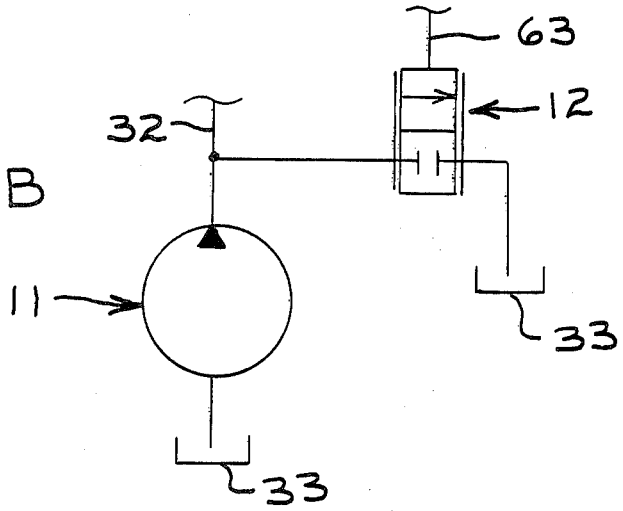
FIG. 1B is a schematic representation of a flow changing mechanism having a bypass control for use with a fixed displacement pump.

Referring now to FIG. 1, a controller, generally designated as 10, is interposed between diagrammatically shown pump 11, with its flow changing mechanism 12 and a direction control valve, generally designated as 13. As is well known in the art the flow changing mechanism 12 may be of the displacement type, in which the flow output of the pump 11 may be changed by change in its displacement, or may be of a bypass type, in which the flow output of the pump 11 may be changed by a bypass control. The direction control valve 13 comprises a housing 14 provided with an inlet chamber 15, two load chambers 16 and 17 and two exhaust chambers 18 and 19. All of those chambers can be selectively interconnected with each other by a valve spool 20. The valve spool 20 is provided with positive load metering slots 21 and 22, negative load metering slots 23 and 24 and signal slots 25 and 26, which selectively communicate with positive load sensing ports 27 and 28. The load chambers 16 and 17 are directly connected to a fluid motor 29. The inlet chamber 15, shown connected to the pump 11 through load check 30, discharge line 31, controller 10 and line 32, can be directly connected by a discharge line to the pump 11. The exhaust chambers 18 and 19 are connected by lines, not shown, to the exhaust circuit including a reservoir 33.

The controller 10 is provided with a control spool 34, slidably guided in bore 35 of a controller housing 36. One end of the control spool 34 communicates with a first control chamber 37, connected by line 38 with discharge line 31. The other end of the control spool 34 protrudes into a second control chamber 39 and is subjected to biasing force of spring 40. The second control chamber 39 is connected by signal line 41 and signal check valve 42 with positive load sensing ports 27 and 28 of direction control valve 13. Signal line 41 is also connected through signal check valve 43 with positive load sensing ports of schematically shown direction control valve 44 controlling fluid motor 45.

A first control piston 46, with its stem section 47 and a flange section 48, is slidably guided in sealing engagement in bores provided in the controller housing 36. The stem section 47 with one end protrudes into the first control chamber 37 and selectively engages the control spool 34, while the other end communicates with a balancing chamber 49, the first control chamber 37 and the balancing chamber 49 being interconnected by passage 50. The flange section 48 of the first control piston 46 defines space 51, subjected to control pressure of control signal 52 and space 53, connected to the system reservoir 33.

A second control piston 54, which may be identical to the first control piston 46, is provided with a stem section 55 and a flange section 56. One end of the stem section 55 protrudes into second control chamber 39 and selectively engages the control spool 34, while the other end communicates with a balancing chamber 57, the second control chamber 39 and the balancing chamber 57 being interconnected by passage 58. The flange section 56 of the second control piston 54 defines space 59, subjected to control pressure of control signal 60 and space 61, connected to the system reservoir 33. The system reservoir 33 is connected by line 62 to the controller 10, which may also be connected by line 63 with the flow changing mechanism 12.

Figure 2:
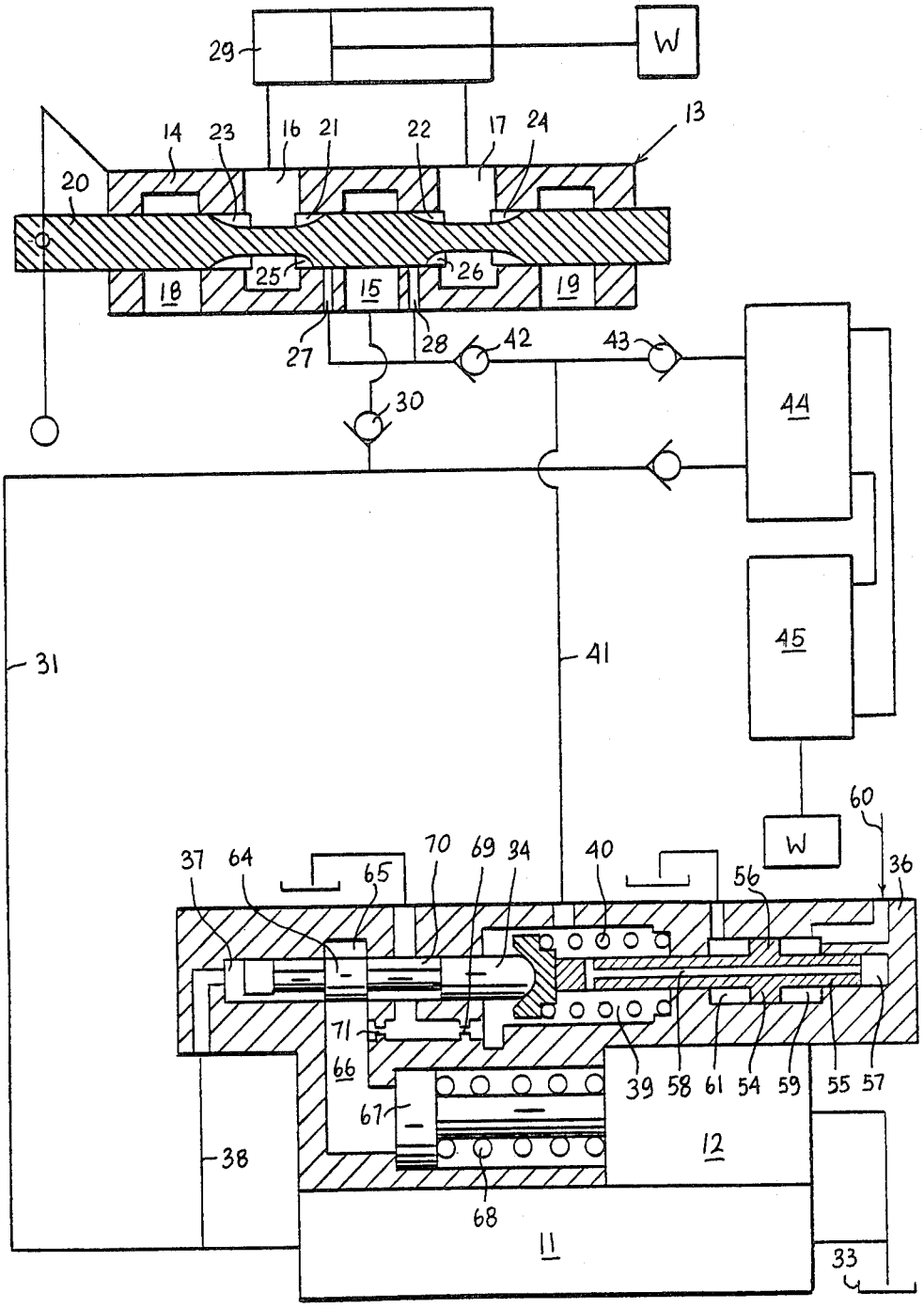
FIG. 2 is a diagrammatic representation of a fluid power direction and flow control system of FIG. 1 using variable pressure differential load compensated pump control, responsive to an external pressure control signal, with system pump, pump flow control mechanism and second system direction control valve shown schematically.

Referring now to FIG. 2, like components of FIGS. 1 and 2 are designated by like numerals. The direction control valve 13 of FIG. 2 is identical in all of its details to direction control valve 13 of FIG. 1 and so is the second control piston 54 identical in FIGS. 1 and 2. The control spool 34 is provided with metering land 64, which meters fluid flow into control groove 65, connected by passage 66 to an actuating piston 67, biased by a spring 68. Leakage orifice 69 is interposed between the second control chamber 39 and annular space 70, connected to the reservoir 33. Leakage orifice 71 is interposed between passage 66 and annular space 70.

Figure 3:
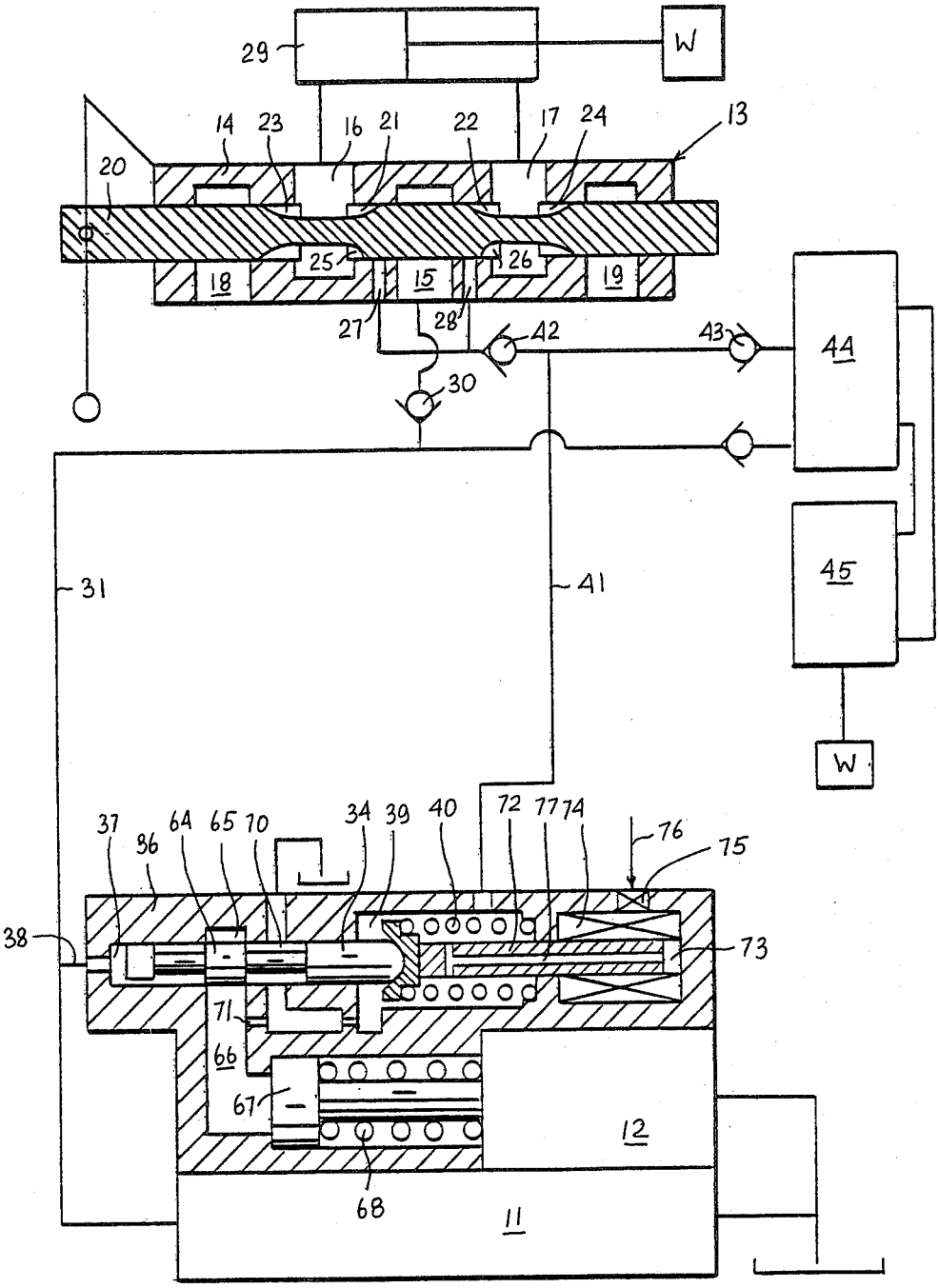
FIG. 3 is a diagrammatic representation of the fluid power direction and flow control system of FIG. 2 with variable pressure differential load compensated pump control responsive to an external electrical control signal.

Referring now to FIG. 3, like components of FIGS. 1, 2, 3 are designated by like numerals. The control spool 34 of FIG. 2 is identical to the control spool 34 of FIG. 3. A cylindrical armature 72, slidably guided in the controller housing 36, selectively engages through a spring retainer the control spool 34. The cylindrical armature 72 also protrudes into a chamber 73, housing a solenoid coil 74, connected to a sealing connector 75, to which external electrical control signal 76 is applied. The chamber 73 is connected with the second control chamber 39 through passage 77.

Referring back now to FIG. 1, displacement of the valve spool 20 from its neutral position, in either direction, will create a control orifice between the inlet chamber 15 and either of the load chambers 16 or 17, while connecting the positive load sensing port 27 or 28, through signal slot 25 or 26, with load chamber 16 or 17. Fluid flow, on its way to fluid motor 29, in a well known manner, will result in a pressure drop across the created control orifice. The first control chamber 37 is connected through line 38 and discharge line 31 to the inlet chamber 15 and therefore is subjected to the pressure upstream of the orifice, created by displacement of positive load metering slot 21 or 22. The second control chamber 39 is connected through line 41 and signal check valve 42 to the positive load sensing ports 27 and 28, one of which is connected to the pressure down stream of control orifice and therefore is connected to the load pressure. Therefore the control spool 34 is subjected, at all times, to the pressure drop developed across the control orifice. The control spool 34 is also subjected, in the second control chamber 39, to the biasing force of the spring 40, which opposes the force generated by the pressure differential existing between the first control chamber 37 and the second control chamber 39. If the control spool 34 is of a fluid throttling type, as shown in my U.S. Pat. No. 3,470,694, it will automatically assume a throttling position, to sufficiently throttle the fluid flow supplied to the inlet chamber 15, to maintain a constant pressure differential across the control orifice and therefore a constant pressure differential between the first control chamber 37 and the second control chamber 39. In a well known manner this constant pressure differential will be equal to the quotient of the preload in the spring 40 and the cross-sectional area of the control spool 34. If the control spool 34 is of a fluid bypass type, as shown in U.S. Pat. No. 3,488,953 issued to Haussler it will automatically bypass enough fluid through line 62 to the system reservoir 33, to maintain a constant pressure differential, equivalent to preload in the spring 40, across the control orifice and between the first control chamber 37 and the second control chamber 39. If the control spool 34 is of a signal generating type it will automatically deliver a control signal through line 63 to the flow changing mechanism 12 of the pump 11, to vary the pump flow delivered to the inlet chamber 15, to maintain a constant pressure differential, equivalent to preload in the spring 40, across the control orifice and between the first control chamber 37 and the second control chamber 39. Once the pressure differential is maintained constant at any specific level across a control orifice, in a well known manner, the flow through the control orifice will be proportional to the orifice area and independent of the variation in the magnitude of the load pressure which is the pressure upstream of the control orifice.

The first control piston 46 with its stem section 47 can engage the control spool 34 and transmit to it a control force. Since the pressure in the balancing chamber 49, through action of the passage 50 is the same as that in the first control chamber 37, the effect of pressure on the cross-sectional area of the stem section 47 is completely balanced. If space 51 is subjected to pressure of control signal 52 and space 53 is connected to the system reservoir 33, a control force, equal to the product of the control pressure and the annular area of the first control piston 46, will be generated and transmitted to the control spool 34. If the effective annular area of the first control piston 46 is selected the same as the cross-sectional area of the control spool 34, any value of the control pressure in space 51 will reduce, by an identical amount, the pressure differential between the first control chamber 37 and the second control chamber 39, reducing by the same amount the value of the pressure differential across the control orifice, this pressure differential at this new level still being maintained constant by the action of the control spool 34. Therefore the pressure differential, developed across the control orifice, can be proportionally varied in respect to the control signal 52 from a maximum value, equivalent to preload in the spring 40, to any lesser value and automatically maintained constant at each selected level. In an identical way, with space 51 subjected to zero pressure and space 59 subjected to control pressure of the control signal 60, through the action of the second control piston 54 the pressure differential across the control orifice and across the control spool 34 can be varied above the level, equivalent to preload of the spring 40. The value of this pressure differential will be proportional to the magnitude of the control signal 60 and automatically maintained constant at each selected level.

Referring now to FIG. 2 the control spool 34 is subjected to the load pressure in the second control chamber 39 and to the biasing force of the spring 40, while the other end is subjected to the pump discharge pressure in the first control chamber 37. The control spool 34, subjected to those forces, assumes a modulating position, as shown in FIG. 2, in which by variation in pressure in passage 66 and control of the pump flow through piston 67 it maintains pump discharge pressure, higher by a constant pressure differential, than the load pressure. In this way a constant pressure differential, equivalent to the preload in the spring 40, is automatically maintained across a control orifice, created by displacement of the metering slot 21 or 22, of the direction control valve 13. The second control piston 54, identical to that of FIG. 1, with its hydraulically balanced stem section 55 transmits control force to the control spool 34, proportional to the pressure in the space 59, which is dictated by the control signal 60. A control force, proportional to pressure in space 59, is then transmitted directly to the control spool 34 adding to the biasing force of spring 40 and disturbing the equilibrium of forces, to which the control spool 34 is subjected. The resulting change in pressure in passage 66 and increase in the flow output of the pump 11 will raise the pump discharge pressure to a level, which will increase the pressure differential acting across the control orifice of the direction control valve 13. This pressure differential will now be maintained constant at this higher level, with the control spool 34 returning to its modulating equilibrium position. Therefore increase in the level of the control pressure in the space 59 will proportionally increase the level of the pressure differential acting across the control orifice. In this way, by variation in the control pressure of the control signal 60, the controlled pressure differential of the system can be proportionally varied above the minimum level, equivalent to preload in the spring 40. This pressure differential being automatically maintained constant at each selected level. The second control piston 54, in a manner as described when referring to FIG. 1, can be positioned to engage the control spool 34 on its opposite end in the first control chamber 37. Then the control force, transmitted to the control spool 34, will vary the pressure differential of the system below the level, equivalent to the preload in the spring 40, this pressure differential automatically being maintained constant at each selected level.

Referring now to FIG. 3 the armature 72, hydraulically balanced and guided in the housing 36, selectively engages control spool 34 through a spring retainer. One end of the armature 72 is located inside the coil 74, forming a solenoid, well known in the art. Such a solenoid will generate an axial force in its armature, proportional to the input current of external control signal 76, transmitted through the sealed connector 75. In this way the armature 72 will transmit a mechanical force to the control spool 34 proportional to the magnitude of the electrical control signal 76. This mechanical control force, by changing the equilibrium of the forces, to which the control spool 34 is subjected, in a manner as described when referring to FIG. 2, will increase the pressure differential of the system to a higher level. Therefore in the control system of FIG. 3 the pressure differential of the control will vary proportionally to the magnitude of the electrical input signal 76, this pressure differential being automatically maintained constant at each specific level, higher than that equivalent to the preload of the spring 40. The solenoid, composed of the armature 72 and the coil 74, can be positioned to engage the opposite end of the control spool 34 from the side of the first control chamber 37, proportionally controlling the pressure differential of the system, below the level equivalent to the preload of the spring 40.

Although the preferred embodiments of this invention have been shown and described in detail it is recognized that the invention is not limited to the precise from and structure shown and various modifications and rearrangements as will occur to those skilled in the art upon full comprehension of this invention may be resorted to without departing from the scope of the invention as defined in the claims.

What is claimed is:

1. A load responsive fluid control system comprising a pump and a fluid motor, control orifice means interposed between said pump and said fluid motor, control means including control member means interposed between said control orifice means and said pump operable to maintain a pressure differential acting across said control orifice means constant at a predetermined level, first force generating means in said control member means responsive to pressure upstream of said orifice means, second force generating means in said control member means responsive to load pressure down stream of said orifice means, third force generating spring biasing means opposing said first force generating means, and fourth force generating means responsive to an external control signal operable to transmit force to said control member, said fourth force generating means having force balancing means operable to balance force generated by said load pressure, and means operable to generate a force proportional to the magnitude of said external control signal whereby said pressure differential across said control orifice means can be proportionally varied with the magnitude of said external control signal while said pressure differential is maintained constant at each selected level.

2. A flow control system as set forth in claim 1 wherein said control means includes pump displacement changing means.

3. A flow control system as set forth in claim 1 wherein said control means includes pump flow bypass means.

4. A flow control system as set forth in claim 1 wherein said control means includes fluid flow throttling means.

5. A flow control system as set forth in claim 1 wherein said control means includes fluid flow throttling bypass means.

6. A flow control system as set forth in claim 1 wherein said control means includes power amplifying pilot valve means and pump displacement changing means.

7. A flow control system as set forth in claim 1 wherein said control means includes power amplifying pilot valve means and fluid throttling means controlled by said power amplifying pilot valve means.

8. A flow control system as set forth in claim 1 wherein said control means includes pilot valve means and fluid bypass means controlled by said power amplifying pilot valve means.

9. A flow control system as set forth in claim 1 wherein said means responsive to signal pressure has means operable to generate control force opposing force generated by said first force generating means.

10. A flow control system as set forth in claim 1 wherein said means responsive to signal pressure has means operable to generate control force aiding force generated by said first force generating means.

11. A flow control system as set forth in claim 1 wherein said fourth force generating means includes solenoid force generating means responsive to an electrical control signal.

12. A flow control system as set forth in claim 11 wherein said solenoid force generating means includes armature means and pressure balancing means on said armature means.

13. A flow control system as set forth in claim 11 wherein said solenoid force generating means has means operable to generate control force oppposing force generated by said first force generating means.

14. A flow control system as set forth in claim 11 wherein said solenoid force generating means has means operable to generate control force aiding force generated by said first force generating means.

* * * * *